US012007216B2

(12) United States Patent
Striuli

(10) Patent No.: US 12,007,216 B2
(45) Date of Patent: Jun. 11, 2024

(54) STABILISING VANE FOR ARCHERY OR CROSSBOW ARROWS

(71) Applicant: Top Flight Archery di Christian Striuli, Limana (IT)

(72) Inventor: Christian Striuli, Limana (IT)

(73) Assignee: Top Flight Archery di Christian Striuli, Limana BL (IT)

( * ) Notice: Subject to any disclaimer, the term of this patent is extended or adjusted under 35 U.S.C. 154(b) by 0 days.

(21) Appl. No.: 17/952,397

(22) Filed: Sep. 26, 2022

(65) Prior Publication Data

US 2023/0102323 A1 Mar. 30, 2023

(30) Foreign Application Priority Data

Sep. 27, 2021 (IT) ..... 102021000024626

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS 4,488,728 A * 12/1984 Humphrey ..... F42B 6/06 473/586
5,613,688 A * 3/1997 Carella ..... F42B 10/26 473/586
6,958,023 B2 * 10/2005 Simo ..... F42B 6/06 473/586
8,105,189 B1 * 1/2012 Huang ..... F42B 6/06 473/586
8,323,133 B1 * 12/2012 Middendorf ..... F42B 6/06 473/586
8,523,718 B1 9/2013 Kuhn
2014/0004983 A1 1/2014 Delap et al.
2015/0105193 A1 4/2015 Pedersen

OTHER PUBLICATIONS

Search Report, Written Opinion dated May 20, 2022; Application No. 102021000024626; 10 pages.

* cited by examiner

*Primary Examiner* — John A Ricci
(74) *Attorney, Agent, or Firm* — Mark Bandy; Rankin Hill & Clark, LLP

(57) ABSTRACT

A stabilising vane for arrows is described, which comprises:

a base shaped to be connected at a tail of a shaft of an arrow, wherein the base extends along a first direction between a first and a second end; where the first direction coincides with the flight direction of the vane when the arrow is in flight;

a body connected to the base and extending away from the base substantially along a second direction starting from a first point positioned at a marginal position of a first side positioned at the first end and from a second point positioned at a marginal position of a second side positioned at the second end of the base; wherein the body further extends between a third side and a fourth side of the base; the first point and the second point facing the fourth side, the body has an airfoil having a convex upper surface and a concave lower surface; the body has a variable thickness.

11 Claims, 4 Drawing Sheets

STABILISING VANE FOR ARCHERY OR CROSSBOW ARROWS

FIELD OF APPLICATION

The present invention relates to a stabilising vane for arrows, suitable to be mounted on archery or crossbow arrows.

The present invention may be usefully used in sporting, recreational or competitive contexts, as well as hunting and more.

DESCRIPTION OF THE PRIOR ART

Various types of stabilising vanes are known in the prior art. Such vanes are positioned at a tail end of an arrow, and stabilise the direction thereof during flight. In particular, the more the arrow rotates on itself during flight, the less it is deviated. The shape of the vane is what determines the ability of the arrow to turn more or less on itself.

Specifically, the vanes have a base, through which they are connected to the arrow, and a body that extends away from the base and which is essentially what is responsible for the aerodynamic characteristics of the vane. In vanes of the known type, the body may have many different shapes and may have, for example, a shield or parabolic profile.

Problem of the Prior Art

Disadvantageously, the arrows comprising such known vanes are subject to more or less significant deviations by the wind.

SUMMARY OF THE INVENTION

In this context, the technical task underlying the present invention is to provide a stabilising vane for arrows which overcomes the drawbacks of the prior art as described above.

In particular, it is the object of the present invention to make available a stabilising vane for arrows that is aerodynamic and resulting in a fast arrow.

A further object of the present invention is to make available a stabilising vane for arrows that makes it possible to reduce the deviation of the arrow, thereby increasing the spin and thus the accuracy of the shot.

The defined technical task and the specified objects are substantially achieved by a stabilising vane for arrows comprising the technical characteristics set forth in one or more of the appended claims.

BRIEF DESCRIPTION OF THE DRAWINGS

Further characteristics and advantages of the present invention will become more apparent from the approximate and thus non-limiting description of a preferred, but not exclusive, embodiment of a stabilising vane for arrows, as shown in the accompanying drawings, wherein.

DETAILED DESCRIPTION

Figure 1:
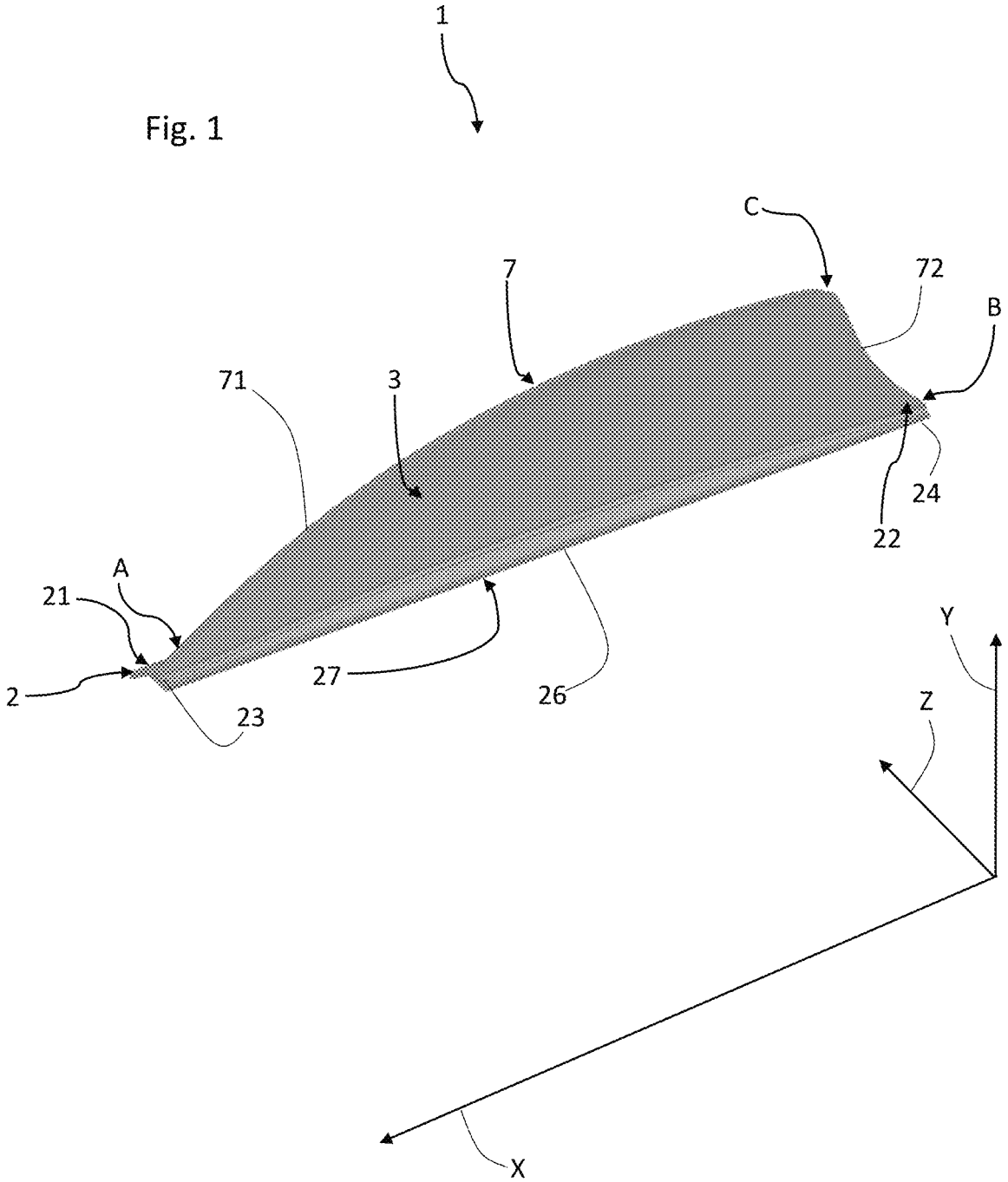
FIG. 1 shows a perspective view of a vane according to the present invention in a first embodiment.
Figure 2:
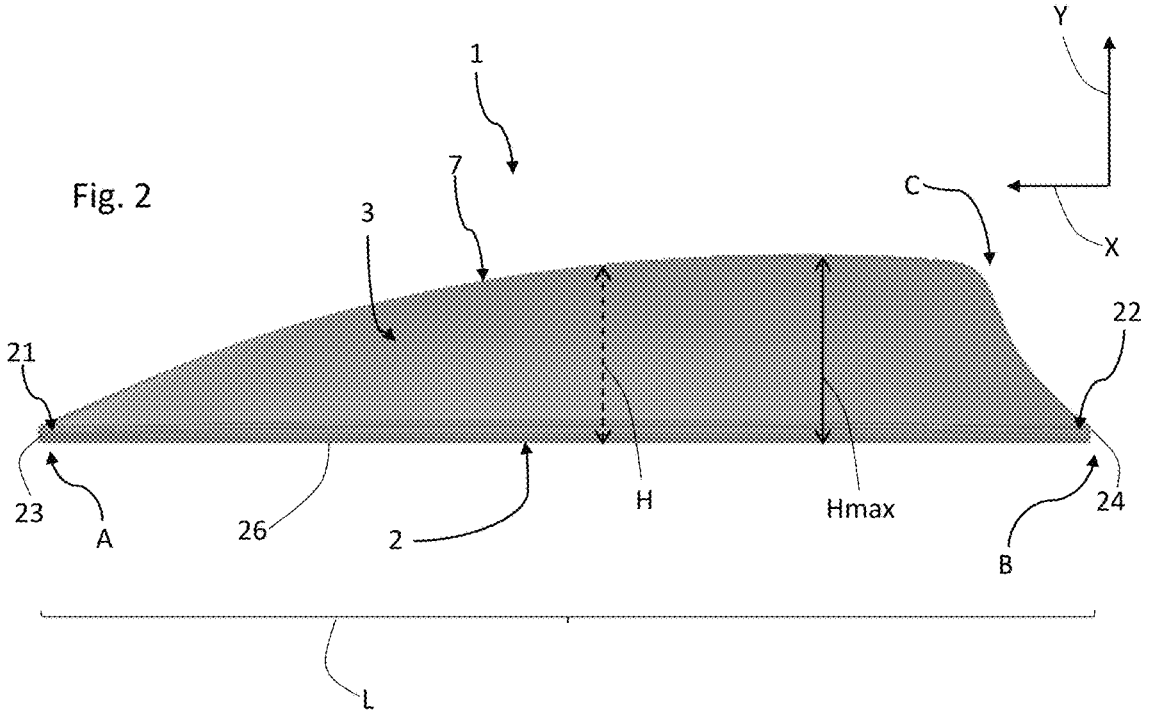
FIG. 2 shows a view from above of the vane of FIG. 1.
Figure 3:
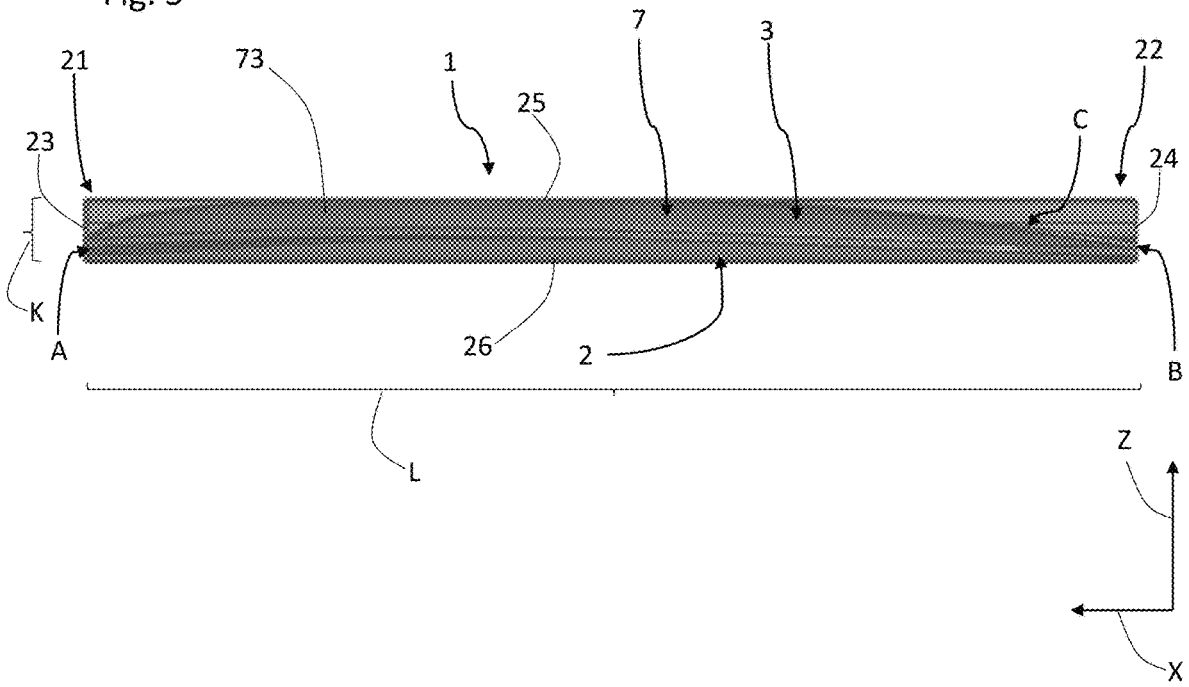
FIG. 3 shows a side view of the vane in FIGS. 1 and 2.
Figure 4:
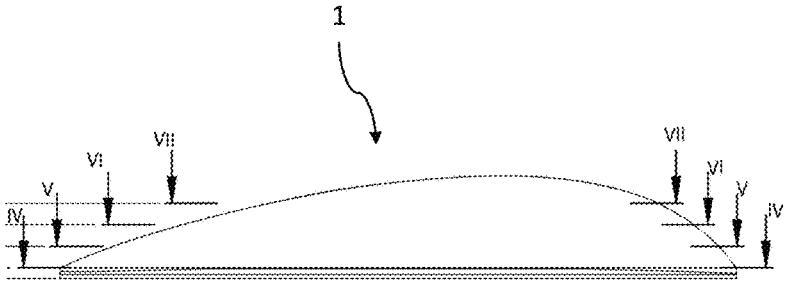
FIG. 4 shows a view from above of a vane according to the present invention in a second embodiment with four different parallel cutting planes.
Figure 4A:
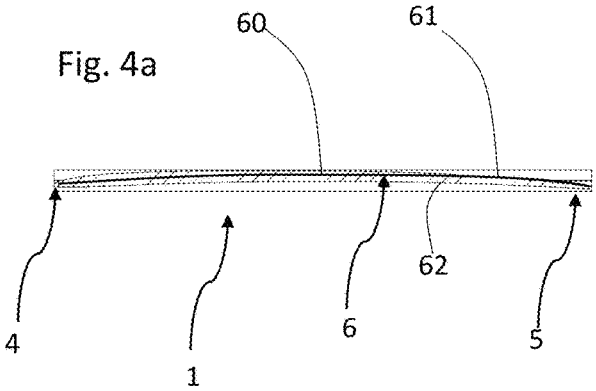
FIGS. 4*a*-4*d* show views from above of respective sections of the vane of FIG. 4 sectioned along the indicated cutting planes.
Figure 4B:
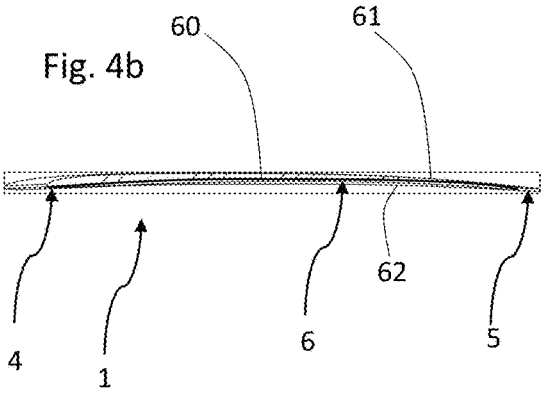
Figure 4C:
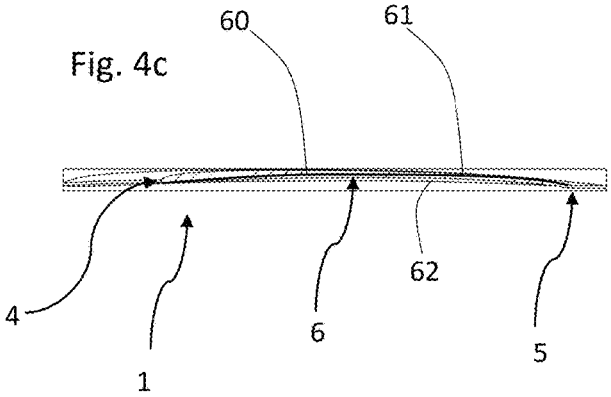
Figure 4D:
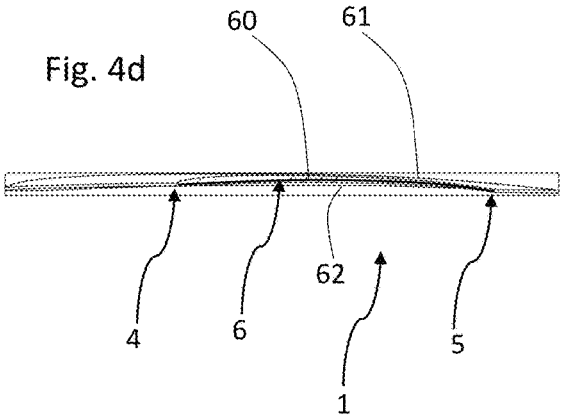
Figure 5:
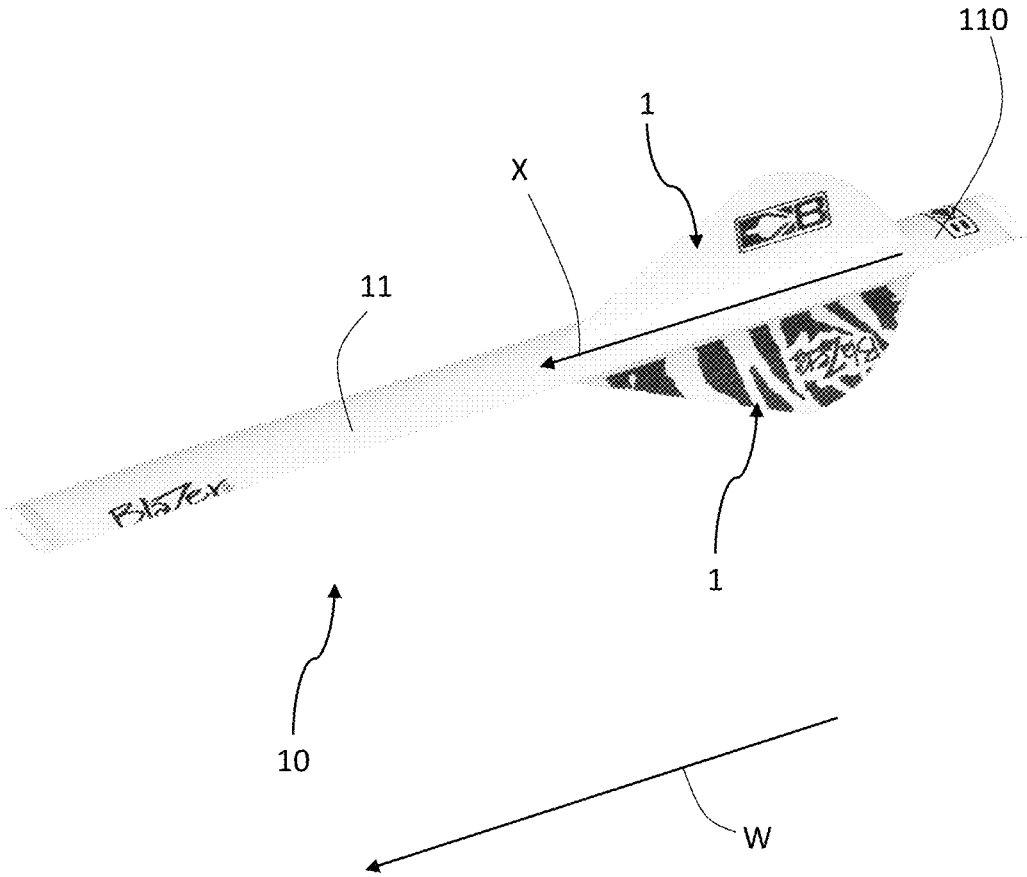
FIG. 5 shows a perspective view of a covering with a vane according to the present invention in a second embodiment.

With reference to the enclosed figures, a stabilising vane for arrows is denoted by 1.

The stabilising vane 1 for arrows comprises a base 2 shaped to be connected at a tail of an arrow shaft. In particular, the base 2 mainly extends along a first direction X between a first 21 and a second end 22. The first direction X determines the flight direction of the vane as it coincides with the movement direction of the arrow when the arrow is in flight. In particular, the first direction X coincides with the flight direction of the vane when the arrow is in flight. According to the present description, a second direction Y and a third direction Z will also be provided as reference. The second direction Y is orthogonal to the first direction X. In particular, the first direction X and the second direction Y are the main extension directions of the vane 1, and define a plane XY wherein the vane 1 substantially extends. The third direction Z is perpendicular to the first direction X and the second direction Y, and is substantially the direction of the thickness of the vane 1.

Preferably, the base 2 has a bottom surface 27 having two connecting faces configured to be connected to the arrow shaft, contacting the arrow shaft. The connecting faces also extend between the first 21 and the second end 22.

At the first end 21, the base 2 has a first side 23. At the second end, the base 2 has a second side 24. The base 2 also has a third side 25 and a fourth side 26, connecting the first side 23 and the second side 24.

The first side 23 and the second side 24 are parallel to each other, as well as the third side 25 and the fourth side 26 are parallel to each other.

The third side 25 and the fourth side 26 are both aligned with the first direction X. The first side 23 and the second side 24, on the other hand, preferably extend along the second direction Y and along the third direction Z, forming an inverted "V". In fact, preferably the above-mentioned connecting faces are inclined and facing each other, and are connected along a central line defining such inverted "V" shape of the first side 23 and the second side 24.

According to the present invention, the vane 1 comprises a body 3 connected to the base 2. In particular, the body 3 extends without interruption from the base 2 on one side opposite the bottom surface 27.

Furthermore, the body 3 extends away from the base 2 substantially along the second direction Y from a first point A and a second point B. Accordingly, the body 3 of the vane 1 substantially extends within the plane XY defined above.

In particular, the first point A is positioned at the first end 21 in a marginal position of the first side 23. The second point B is positioned at the second end 22 in a marginal position of the second side 24.

The body 3 further extends between the third side 25 and the fourth side 26 of the base 2.

The first point A and the second point B are facing the same side, in particular the fourth side 26.

In more detail, the body 3 has a thickness in the third direction Z that is variable along the first direction X and along the second direction Y. In particular, the sections of the body 3 are not constant, assumed for example in planes parallel to the plane XZ, or in planes parallel to the plane YZ, i.e. defined by the second direction Y and the third direction Z. Preferably, the thickness decreases along the second direction Y.

The body 3 has an airfoil 6, characterised by the various geometric parameters that an airfoil has, such as chord 60, leading edge 4, trailing edge 5, upper surface 61 and lower surface 62.

In particular, the airfoil 6 has a convex upper surface 61 and a concave lower surface 62.

Specifically, the upper surface 61 is preferably defined at the third side 25. The lower surface 62 is preferably defined at the fourth side 26.

In particular, the airfoil 6 can be described by means of an NACA profile wherein the parameters are as follows: M is between 1 and 5%, P is between 35.0 and 55.0%, and T is between 1 and 5%, where M represents the maximum distance of the midline from the chord, in particular expressed as a percentage of the chord 60, P represents the position of the point of maximum midline distance along the chord expressed as a percentage of the chord 60, and T represents a maximum thickness parameter expressed as a percentage of the chord 60. More preferably, P is between 40.0% and 50.0%. Still preferably, P is between 42.0% and 47.0%. Always preferably, M and T are between 1.5 and 4.5%.

Preferably, the NACA profile is one of the following: 4404, 3403, 3402, 2402, 2401, 1401, wherein the parameters are respectively: M=4.0%, P=45.0% and T=4.0%; M=3.6%, P=45% and T=3.3%; M=3.2%, P=45% and T=2.8%; M=2.6%, P=45% and T=2.6%; M=2.2%, P=45% and T=1.9%; M=1.8%, P=45% and T=1.8%.

The vane 1 has a length L along the first direction X. In particular, the body 3 also has a length equal to the length L, corresponding to the distance between point A and point B at the base 2. Also the base 2 has a length equal to length L defined as the length of the third side 25 and the fourth side 26.

Preferably, the length L is between 2.54 cm and 12.7 cm (i.e. between 1 inch and 5 inches). More preferably, the length L is 44.45 mm or 52 mm or 59.7 mm or 71.2 mm or 82.5 mm or 104 mm (i.e. 2 inches or 4 inches).

For example, the NACA profile 4404 is used for L=44.45 mm. For example, the NACA profile 3403 is used for L=52 mm. For example, the NACA profile 3402 is used for L=59.7 mm. For example, the NACA 2402 profile is used for L between 69 and 72 mm. For example, the NACA profile 2401 is used for L=82.5 mm. For example, the NACA profile 1401 is used for L=104 mm.

The vane 1 also has a height H along the second direction Y. Such a height H is variable along the second direction Y defining a curved line 7 of the body 3. In particular, the height H is measured from the base 2 to a point located at the curved line 7. The curved line 7 is known in jargon as "profile" and has a curved pattern. The profile, or curved line 7, changes trend along the length L defining a leading edge 71 and a trailing edge 72.

The leading edge 71 and trailing edge 72 each have a respective leading surface 73 and trailing surface 74. The leading surfaces 73 and trailing surfaces 74 are homogeneous and regular and have the same thickness between them.

According to a first embodiment, the vane 1 has a body 3 having a shield profile. According to an alternative embodiment, the vane 1 has a body 3 having a parabolic profile. The vane 1 may also have a body 3 having a stepped shield profile.

According to such profile types, the vane 1 has a maximum height Hmax, preferably between 7 and 15 mm. More preferably, the maximum height Hmax is between 8 and 13 mm.

Preferably, H=8.7 mm for L=44.45 mm. Preferably, H=9.2 mm for L=52 mm and for L=59.7 mm. Preferably, H=12 mm for L=69.5 mm, for L=71.2 mm, for L=82.5 mm and for L=104 mm.

Preferably, the body 3 also has a width K along the third direction Z. In other words, the width K coincides with the dimension of the first side 23 and the second side 24. The width K is preferably between 2.5 mm and 3.5 mm.

The body 3 extends non-linearly along the first direction. Preferably, within the first half of the length L the body 3 curves so as to move closer to the third side 25 and return to a marginal position of the base 2, facing the fourth side 26.

Preferably, the curved line 7 has a homogeneous and regular surface.

According to the embodiment providing a shield profile, a third point C is positioned between the leading edge 71 and trailing edge 72 defining such leading edge 71 and trailing edge 72.

Preferably, in the case of a shield profile, the leading edge 71 partially extends along the first direction X starting from a marginal position of the first side 23 substantially for a distance of about ⅞ to ⅘ of the length L. The trailing edge 72 preferably partially extends along the first direction X starting from a marginal position of the second side 24, at the point of connection with the fourth side 26, substantially for ⅛-⅕ of the length L.

In the case of the parabolic profile, the leading edge 71 and the trailing edge are not clearly separated. Preferably, the leading edge 71 partially extends along the first direction X starting from a marginal position of the first side 23 substantially for a distance between ⅝ and ⅞ of the length L. The trailing edge 72 preferably partially extends along the first direction X starting from a marginal position of the second side 24, at the point of connection with the fourth side 26, substantially for ⅜-⅔ of the length L.

According to such embodiment, the third point C is preferably positioned at 9/10 of the length L of the vane 1.

According to a preferred embodiment, the vane 1 is made by injection moulding.

For example, the vane 1 is made of PVC or TPU. Preferably, the vane 1 is made of TPU characterised by a hardness preferably between 50 and 150 Shore A. More preferably, the TPU is characterised by a hardness between 60 and 100 Shore A. Even preferably, the TPU is characterised by a hardness of 80 Shore A.

The present invention also relates to a covering 10 for arrows which comprises at least one vane 1 as described above. The covering 10 comprises a sheath 11 that extends along a main extension direction W. Specifically, the sheath 11 is configured to fit on an arrow shaft. In particular, an arrow shaft extends along a longitudinal direction that coincides with the main extension direction W of the sheath 11 when the sheath 11 fits on the shaft.

Preferably, the sheath 11 is made of heat-sensitive material. More preferably, the sheath 11 is made of heat-shrinkable material, i.e. a material that shrinks with heat, adhering to the arrow shaft. For example, the material of which the sheath 11 is made is a branched polyolefin or an irradiated polyolefin.

The vanes 1 are positioned at a portion of the end 110 of the sheath 11.

Preferably, the covering 10 comprises between two and six vanes 1.

An arrow (not shown in the accompanying Figures), preferably for archery or crossbow, is also an object of the present invention.

The arrow in particular comprises a shaft extending along a shaft direction between a tip and a tail. The arrow comprises one or more of the above-described vanes 1, at the tail.

According to a type of arrow according to the present invention, specifically, the tail has one or more seats to each accommodate a respective vane 1.

Another type of arrow according to the present invention comprises the above-mentioned covering 10. Therefore, in such a case, the vanes 1 will not be directly connected to the shaft via the above-mentioned seats, but will be connected directly to the sheath 11.

According to a preferred embodiment, each vane 1 is arranged with the first direction X parallel to the shaft direction of the arrow. Unlike arrows made with known vanes, many of which require to be mounted with an angle with respect to the shaft direction of the arrow (i.e. the first direction X and the shaft direction of the arrow form an angle greater than 0°), the arrow thereby made is precise and fast.

Experimental Data

Some data collected as proof of the behaviour of an arrow according to the present invention are reported in the hereinafter table.

The bow used for testing is a 60-pound RH Compound Mathews TRX 38 bow with an AMO draw of 71.12 cm (i.e. 28 inches).

The arrows used for the tests, on which the vanes according to the present invention have been mounted, are of the X 10 ProField 470 type, with a tip of 110 grains.

The tests were performed following the natural direction of rotation of the bow, i.e. counter-clockwise in the case of the above-mentioned RH Compound Mathews bow used.

The following table shows the arrow speeds at 3 m and 14 m from the shooter, the speed difference at 3 m and 14 m from the shooter, and the estimated rotations performed by the arrows made by fitting three or four of the blow indicated vane.

First Test Day

The following types of vanes have been tested:

vane according to the present invention 1st type: length L=52 mm, shield profile, TPU 80 ShA;

vane according to the present invention 2nd type: length L=52 mm, parabolic profile, TPU 80 ShA;

vane according to the present invention 3rd type: length L=52 mm, stepped shield profile, TPU 80 ShA;

vane known as inclined GS 200, length L=52 mm, shield profile, mounted as inclined in a counter-clockwise direction of approx. 1.5/2° (with respect to the shaft direction);

vane known as helical GS 200, shield profile, Bitzemburger helical fletching;

vane known as GX 187 (four-vane arrow), length L=47 mm, stepped shield profile, mounted as inclined in a counter-clockwise direction by approximately 2 degrees (with respect to the direction of the shaft).

| Vane type | Speed at 3 m (ft/s) | Speed at 14 m (ft/s) | Speed difference between 3 and 14 m (ft/s) | Estimated rotations at 50 m |
|---|---|---|---|---|
| Invention vane 1 | 284 | 281 | 3 | 48 |
| Invention vane 2 | — | — | — | 48 |
| Invention vane 3 | — | — | — | 50 |

-continued

| Vane type | Speed at 3 m (ft/s) | Speed at 14 m (ft/s) | Speed difference between 3 and 14 m (ft/s) | Estimated rotations at 50 m |
|---|---|---|---|---|
| Inclined GS | 284 | 281 | 3 | 10 |
| Helical GS | 284 | 279 | 5 | 38 |
| Shield GX | 284 | 280.5 | 3.5 | 18 |

Second Test Day

The following types of GS 200 vanes have been tested:

vane according to the present invention 4th type: NACA 3403-GS 200;

vane known as inclined GS 200 mounted as inclined in a counter-clockwise direction of approx. 1.5° (with respect to the shaft direction); and vane known as helical GS 200, shield profile, Bitzemburger helical fletching.

The following types of GH 200 vanes have been tested:

vane according to the present invention 5th type: NACA 3403-GH 200;

vane known as helical GH 200, shield profile, Bitzemburger helical fletching.

It has also tested an arrow without vanes as reference.

| Vane type | Speed at 3 m (ft/s) | Speed at 14 m (ft/s) | Speed difference between 3 and 14 m (ft/s) | Estimated rotations at 50 m |
|---|---|---|---|---|
| Arrow without vanes | 269 | 267 | 2 | 5 |
| Invention vane 4 | 261 | 258 | 3 | 52 |
| Inclined GS 200 | 263 | 260 | 3 | 10 |
| Helical GS 200 | 261 | 256 | 5 | 38 |

| Vane type | Speed at 3 m (ft/s) | Speed at 14 m (ft/s) | Speed difference between 3 and 14 m (ft/s) | Estimated rotations at 50 m |
|---|---|---|---|---|
| Arrow without vanes | 269 | 267 | 2 | 5 |
| Invention vane 5 | 264 | 261 | 3 | 49 |
| Helical GH 200 | 264 | 259.5 | 4.5 | 46 |

CONCLUSION

The stabilizing vanes according to the present invention generate a lower aerodynamic resistance (drag) and induce a greater arrow spin than those known. Therefore, the vanes according to the present invention allow to reduce the deviation of the arrow without penalizing its speed.

The invention claimed is:

1. Stabilizing vane for arrows, comprising:

a base shaped to be connected at a tail of a shaft of an arrow, said base extending along a first direction between a first and a second end, the first direction coinciding with the flight direction of the vane when the arrow is in flight;

a body connected to the base and extending away from the base substantially along a second direction, orthogonal to the first direction, starting from a first point positioned at a marginal position of a first side positioned at the first end and from a second point positioned at a marginal position of a second side positioned at the second end of said base; said body further extending between a third side and a fourth side of the base; said first point and said second point facing the fourth side, said body having an airfoil having a convex upper surface and a concave lower surface, said body further having a variable thickness wherein said airfoil is described by an NACA airfoil wherein M is between 1.5% and 4.5%, P is between 35.0% and 55.0% and T is between 1.5% and 4.5%.

2. Stabilizing vane according to claim 1, having:

a length along the first direction between 2.54 cm and 12.7 cm;

a height along the second direction variable along said second direction defining a curved line of the body, said stabilizing vane having a maximum height between 7 and 15 mm.

3. Stabilizing vane according to claim 1, wherein the body has a variable thickness along the first direction.

4. Stabilizing vane according to claim 1, wherein the body has a variable thickness along the second direction.

5. Stabilizing vane according to claim 1, wherein said body has a variable thickness along the first direction and along the second direction.

6. Stabilizing vane according to claim 1, made by injection moulding.

7. Stabilizing vane according to claim 1, made of PVC or TPU.

8. Covering for arrows comprising:

a sheath extending along a main extension direction and configured to fit on a shaft of an arrow extending along a longitudinal direction coinciding with said main extension direction when the sheath fits on the shaft;

one or more stabilizing vanes placed at an end portion of the sheath, each stabilizing vane comprising:

a base extending along a first direction between a first and a second end, the first direction coinciding with the main extension direction of the sheath;

a body connected to the base and extending away from the base substantially along a second direction orthogonal to the first direction, said body having an airfoil having a convex upper surface and a concave lower surface, said airfoil being described by an NACA airfoil.

9. Covering according to claim 8, wherein the sheath is made of heat shrinkable material.

10. Arrow comprising:

a shaft extending along a shaft direction between a tip and a tail, one or more stabilizing vanes arranged at the tail, said tail having one or more seats to each accommodate a respective stabilizing vane, each stabilizing vane comprising:

a base shaped to be connected at a tail of a shaft of an arrow, said base extending along a first direction between a first and a second end, the first direction coinciding with the flight direction of the stabilizing vane when the arrow is in flight;

a body connected to the base and extending away from the base substantially along a second direction orthogonal to the first direction, said body having an airfoil having a convex upper surface and a concave lower surface, said airfoil being described by an NACA airfoil.

11. Arrow according to claim 10, wherein each stabilizing vane is arranged with the first direction parallel to the shaft direction.

* * * * *